US010287716B2

(12) United States Patent
Liu et al.

(10) Patent No.: US 10,287,716 B2
(45) Date of Patent: May 14, 2019

(54) FABRIC MANUFACTURING METHOD, MANUFACTURING CONTROL METHOD, MANUFACTURING CONTROL DEVICE AND MANUFACTURING SYSTEM

(71) Applicant: AC Carpi Apparel Company Ltd., Hong Kong (CN)

(72) Inventors: Rong Liu, Hong Kong (CN); Amy Chu, Hong Kong (CN)

(73) Assignee: AC Carpi Apparel Company Ltd., Hong Kong (CN)

( * ) Notice: Subject to any disclaimer, the term of this patent is extended or adjusted under 35 U.S.C. 154(b) by 309 days.

(21) Appl. No.: 14/431,944

(22) PCT Filed: Dec. 13, 2012

(86) PCT No.: PCT/CN2012/086531
§ 371 (c)(1),
(2) Date: Mar. 27, 2015

(87) PCT Pub. No.: WO2014/048039
PCT Pub. Date: Apr. 3, 2014

(65) Prior Publication Data

US 2015/0247268 A1 Sep. 3, 2015

(30) Foreign Application Priority Data

Sep. 29, 2012 (CN) ..... 2012 1 0379627

(51) Int. Cl.
*D04B 15/66* (2006.01)
*D04B 1/22* (2006.01)
*D04B 1/10* (2006.01)

(52) U.S. Cl.
CPC ..... *D04B 15/66* (2013.01); *D04B 1/102* (2013.01); *D04B 1/22* (2013.01)

(58) Field of Classification Search
CPC ..... D04B 15/66; D04B 15/78; D04B 1/102; D04B 37/00; D04B 37/02; D04B 37/06
(Continued)

(56) References Cited

U.S. PATENT DOCUMENTS 4,180,065 A * 12/1979 Bowen ..... A61F 13/08 2/239
4,502,301 A * 3/1985 Swallow ..... A61F 13/08 602/62

(Continued)

FOREIGN PATENT DOCUMENTS

CA 2550980 A1 * 7/2005 ..... A41B 11/00
CN 1070752 A 4/1993

(Continued)

OTHER PUBLICATIONS

First Office Action and English Summary for Taiwanese Application No. 102104826 dated Jul. 30, 2015, 14 pages.

(Continued)

*Primary Examiner* — Nathan E Durham
(74) *Attorney, Agent, or Firm* — RMCK Law Group, PLC

(57) ABSTRACT

Disclosed are a fabric manufacturing method, a manufacturing control method, a manufacturing control device and a manufacturing system, wherein the fabric manufacturing method comprises the steps of: obtaining information of a fabric function area setting performed using human morphology information, motional force analysis data and heat and moisture analysis data, wherein the information of the fabric function area setting comprises fabric function area type information; calling a corresponding relationship between the fabric function area type information and knitting member information, wherein the knitting member information comprises knitting stitch structure information and knitting action information; and performing integrated (Continued)

forming and seamless knitting of the fabrics according to the control instructions corresponding to the knitting stitch structure information and the knitting action information. The present invention achieves the technical effects, such as strengthening the supporting and protecting effect of the fabrics on moving human bodies and improving the ductility and wearing comfort of the fabrics.

13 Claims, 17 Drawing Sheets

(58) Field of Classification Search
USPC ..... 66/232; 700/132, 141
See application file for complete search history.

(56) References Cited

U.S. PATENT DOCUMENTS 4,527,402 A * 7/1985 Swallow ..... A61F 13/08 2/239
5,388,050 A * 2/1995 Inoue ..... D04B 15/66 66/232
5,511,394 A * 4/1996 Shima ..... D04B 1/24 66/232
5,557,527 A * 9/1996 Kotaki ..... D04B 15/66 66/232
5,615,318 A * 3/1997 Matsuura ..... A41H 3/007 345/419
5,754,431 A * 5/1998 Kotaki ..... D04B 37/02 700/131
5,812,110 A * 9/1998 Kawasaki ..... D04B 37/02 112/470.04
5,862,682 A * 1/1999 Maenaka ..... D04B 15/68 66/218
5,930,769 A * 7/1999 Rose ..... G06Q 30/06 345/419
6,158,253 A * 12/2000 Svoboda ..... A41B 11/004 2/239
6,233,496 B1 * 5/2001 Ippitsu ..... G05B 19/41885 700/133
6,272,888 B1 * 8/2001 Fujita ..... A41B 13/005 2/111
6,546,309 B1 * 4/2003 Gazzuolo ..... G06Q 30/0601 33/512
6,546,560 B2 * 4/2003 Fusco ..... A41D 7/00 2/227
6,553,138 B2 * 4/2003 Rozin ..... G06T 17/00 382/106
6,564,118 B1 * 5/2003 Swab ..... G06Q 30/02 700/130
6,684,412 B2 * 2/2004 Ricci ..... A61F 13/08 2/240
6,711,455 B1 * 3/2004 Holloway ..... A41H 3/007 700/131
6,968,075 B1 * 11/2005 Chang ..... G06K 9/00214 382/111
7,020,538 B2 * 3/2006 Luhnow ..... A41H 1/00 700/132
7,203,566 B2 * 4/2007 Terai ..... D04B 37/02 66/232
7,213,419 B2 * 5/2007 Hardee ..... A41D 19/0065 2/159
7,460,927 B1 * 12/2008 Lai ..... D04B 37/00 66/232
7,493,245 B2 * 2/2009 Suzuki ..... D04B 37/00 66/232
7,555,921 B2 * 7/2009 Thompson ..... A41D 19/0096 2/159
7,716,143 B2 * 5/2010 Shemula ..... G06Q 30/0641 705/500
7,800,626 B2 * 9/2010 Maeiwa ..... G06T 3/005 345/582
7,895,863 B2 * 3/2011 Smith ..... A61F 13/08 66/172 E
8,174,521 B2 * 5/2012 Harvill ..... G06T 15/04 345/419
8,355,811 B2 * 1/2013 Isogai ..... G06F 17/5018 700/132
2001/0026272 A1 * 10/2001 Feld ..... A41H 3/007 345/419
2002/0186422 A1 * 12/2002 Chang ..... H04N 1/04 358/474
2003/0025073 A1 * 2/2003 Liu ..... H04N 1/486 250/234
2003/0035152 A1 * 2/2003 Wang ..... H04N 1/40056 358/474
2003/0191552 A1 * 10/2003 Nishikawa ..... D04B 37/02 700/141
2004/0016041 A1 * 1/2004 Uno ..... A41B 9/06 2/113
2005/0039495 A1 * 2/2005 Suzuki ..... D04B 37/02 66/232
2005/0085938 A1 * 4/2005 Wang ..... D04B 15/66 700/141
2006/0142891 A1 * 6/2006 Kenji ..... D04B 1/24 700/131
2007/0005174 A1 * 1/2007 Thomas ..... G06Q 30/02 700/132
2007/0088453 A1 * 4/2007 Noriyuki ..... D04B 37/02 700/141
2007/0168076 A1 * 7/2007 Manabu ..... D04B 1/126 700/141
2007/0173968 A1 * 7/2007 Koichi ..... A41H 3/007 700/141
2007/0250203 A1 * 10/2007 Yamamoto ..... G06T 19/00 700/132
2009/0019895 A1 * 1/2009 Kawasaki ..... D04B 37/02 66/232
2009/0082898 A1 * 3/2009 Terai ..... D04B 37/02 700/141
2009/0165688 A1 * 7/2009 Li-Tsang ..... A61F 13/00987 112/475.05
2009/0171496 A1 * 7/2009 Furukawa ..... G06F 17/5009 700/131
2009/0222127 A1 * 9/2009 Lind ..... A41H 3/007 700/132
2009/0314039 A1 * 12/2009 Klumpp ..... D04B 1/26 66/187
2010/0130903 A1 * 5/2010 Rock ..... A61F 13/06 602/62
2011/0016602 A1 * 1/2011 Berns ..... A41D 13/1263 2/69
2011/0148864 A1 * 6/2011 Lee ..... G06K 9/00221 345/419
2012/0162217 A1 * 6/2012 Lim ..... G06T 15/205 345/419
2012/0266635 A1 * 10/2012 Habert ..... D04B 15/66 66/171
2013/0301911 A1 * 11/2013 Rong ..... G06K 9/00369 382/160
2014/0307955 A1 * 10/2014 Liu ..... G06K 9/00362 382/154
2015/0247268 A1 * 9/2015 Liu ..... D04B 1/102 66/232

FOREIGN PATENT DOCUMENTS

CN 1407158 A 4/2003
CN 1410610 A 4/2003
CN 1470030 A 1/2004
CN 201115423 Y 9/2008
CN 101661526 A 3/2010
CN 201609124 U 10/2010
CN 102524998 A 7/2012
CN 102534978 A 7/2012
DE 10223753 A1 11/2003
DE 202009018411 U1 9/2011
EP 0964091 A2 * 12/1999 ..... A41B 11/14

(56) References Cited

FOREIGN PATENT DOCUMENTS

| | | | | | |
|---|---|---|---|---|---|
| GB | 2309709 | * | 8/1997 | ..... | D04B 1/24 |
| JP | H0578960 | A | 3/1993 | | |
| JP | 2004204420 | A | 7/2004 | | |
| WO | 2012096921 | A2 | 7/2012 | | |
| WO | WO 2012096921 | A2 * | 7/2012 | ..... | A41D 27/28 |

OTHER PUBLICATIONS

Zhou, S. et al., "Fabric Structure and Finished Size Prediction for Seamless Knitted Garments" and English Abstract, Journal of Textile Research, vol. 30, No. 2, Feb. 2009, 6 pages.
PCT International Search Report dated May 23, 2013 for PCT International Application No. PCT/CN2012/086531, 5 pages.
Zhejiang Sci-Tech University Master's Thesis, "The Research for Properties of Outlast Viscose Seamless Knitted Fabric With Thermo-regulated Performance," Mar. 5, 2012, 81 pages.
Extended European Search Report dated Jun. 21, 2016 for EP Application No. 12885383.5, 11 pages.

* cited by examiner

FABRIC MANUFACTURING METHOD, MANUFACTURING CONTROL METHOD, MANUFACTURING CONTROL DEVICE AND MANUFACTURING SYSTEM

The present application claims the priority to Chinese Patent Application No. 201210379627.3, entitled "FABRIC MANUFACTURING METHOD, MANUFACTURING CONTROL METHOD, MANUFACTURING CONTROL DEVICE AND MANUFACTURING SYSTEM", filed on Sep. 29, 2012 with the State Intellectual Property Office, which is incorporated herein by reference in its entirety.

TECHNICAL FIELD

The present invention relates to the technical field of digital knitting technology, and in particular to a manufacturing method, a manufacturing control method, a manufacturing control device and a manufacturing system for performing integrated forming and seamless knitting of a fabric.

BACKGROUND

Fabrics are made of natural or synthetic fibers. With the development of science and technology, the manufacturing process of knitted fabrics makes rapid progress. Body-fitted and compression sportswears are growing fast in recent years to meet people's diverse wants and needs.

Existing body-fitted and compression sportswears mainly provide support and protection for major muscular groups and soft tissues through additional inserted supportive bandages or protective paddings to prevent from damages during a strenuous exercise; Moreover, enhanced protective devices are provided at positions where high stresses are loaded (e.g., shoulders, knees, and elbows) by sewing or bonding methods to enhance the local anti-impact ability of human body.

However, conventional additional inserted components such as supportive bandages (e.g., TPU bandage) or protective paddings (e.g., sponge padding) provided at body parts which are vulnerable during exercise may restrict stretching movements of human body because of the limited elongation and elasticity of the supportive bandage. For example, during muscle contraction or relaxation, the excessive local pressure produced by the supportive bandage makes athletes feel restrictedly tight and constrained when large limb movements are performed; the seams located between the protective padding and the main body of the fabric tend to irritate the skin; and the above mentioned additional inserted components affect the air permeability and perspiration transfer of the kinetic body parts, which further reduces the wearing comfort.

SUMMARY

In view of this, the present invention provides a fabric manufacturing method, a manufacturing control method, a manufacturing control device and a manufacturing system, for achieving the technical effects of improving the local and systematic mechanical support and moisture absorption and perspiration transfer of the fabric, strengthening the protective effect of the fabric on dynamic human bodies and improving the ductility and wearing comfort of the fabric.

A fabric manufacturing method is provided, which comprises:

obtaining information of a fabric functional area setting performed using human morphology information, biomechanical analysis data on kinetic and kinematic, and heat and moisture analysis data, wherein the information of the fabric functional area setting comprises fabric functional area type information;

calling a corresponding relationship between the fabric functional area type information and knitting element information which comprises knitting stitch structure information and knitting action information; and performing integrated forming and seamless knitting of the fabrics according to control instructions corresponding to the knitting stitch structure information and the knitting action information.

Optionally, obtaining information of a fabric functional area setting performed using human morphology information, biomechanical analysis data on kinetic and kinematic, and heat and moisture analysis data comprises:

obtaining information of supportive functional area setting generated using human muscular group distribution information and biomechanical analysis data on kinetic muscular groups, wherein types of the supportive functional area comprise a reticular mechanical supportive banding group provided at positions corresponding to major kinetic muscular groups, and a gradient supportive banding provided in connection with the mechanical supportive banding; and obtaining information of heat dissipation functional area setting generated using motional heat and moisture analysis data, wherein types of heat dissipation functional area comprise a perspiration transfer area, a moisture absorption and breathable area, a protective thermal buffering area and a thermal buffering area.

Optionally, calling the corresponding relationship between the fabric functional area type information and the knitting element information comprises:

calling a corresponding relationship between the supportive banding and a first knitting element information, and a corresponding relationship between the gradient supportive banding and a second knitting element information, wherein the first knitting element information comprises information of one or any combination of a rib bundle stitch element, a missing stitch element, or a tuck stitch element, and the second knitting element information comprises information of one or any combination of a float plating stitch element, a combined element formed by alternative missing stitch and float plating stitch element, or a jacquard plating stitch element; and calling a corresponding relationship between the perspiration transfer area and a third element information, a corresponding relationship between the moisture absorption and breathable area and a fourth element information, a corresponding relationship between the protective thermal buffering area and a fifth element information, and a corresponding relationship between the thermal buffering area and a sixth element information, the third element information comprises reticular mesh element information;

the fourth element information comprises information of the float plating stitch element and/or the jacquard plating stitch element;

the fifth element information comprises information of the missing stitch element and/or the combined elements formed by alternative missing stitch and float plating stitch element; and the sixth element information comprises information of the float plating stitch elements and/or the jacquard plating stitch elements.

Optionally, types of the supportive functional area further comprise an enhanced supportive area and an enhanced protective padding provided at positions corresponding to parts vulnerable in motion and soft tissues prone to vibration in motion; and obtaining the corresponding relationship between the fabric functional area type information and knitting element information comprises:

obtaining a corresponding relationship between 1) the enhanced supportive area and the enhanced protective padding and 2) a seventh element information which comprises information of the missing stitch element with adjustable tensile compactness and the rib bundle stitch element with adjustable compressibility.

Optionally, providing the enhanced supportive area and the enhanced protective paddings at positions corresponding to parts vulnerable in motion and soft tissues prone to vibration in motion comprises:

providing the enhanced supportive area and the enhanced supportive padding in areas corresponding to abdominal muscles, an iliopsoas muscle, a lateral latissimus dorsi muscle, muscles in back shoulders and elbows of an upper body, and in areas corresponding to a preabdomen, a lower back, lower buttocks and patellas of a lower body, respectively.

Optionally, the integrated forming and seamless knitting of the fabric performed according to the knitting stitch structure information and the knitting action information comprises:

performing the integrated forming and seamless knitting of the fabric using superfine polyester functional yarn and polyamide elastic covering yarn according to the knitting stitch structure information and the knitting action information.

A fabric manufacturing control method is provided, which comprises:

performing fabric functional area setting using human morphology information, biomechanical analysis data on kinetic and kinematic, and heat and moisture analysis data, wherein the information of the fabric functional area setting comprises fabric functional area type information;

constructing a corresponding relationship between the fabric functional area type information and knitting element information which comprises knitting stitch structure information and knitting action information; and generating control instructions carrying the knitting stitch structure information and the knitting action information, and instructing integrated forming and seamless knitting of the fabric according to the knitting stitch structure information and the knitting action information.

Optionally, performing fabric functional area setting using human morphology information, biomechanical analysis data on kinetic and kinematic, and heat and moisture analysis data comprises:

performing supportive functional area setting using human muscular group distribution information as well as biomechanical analysis data on kinetic muscular groups, wherein types of the supportive functional area comprise a reticular mechanical supportive banding group provided at positions corresponding to major kinetic muscular groups, and a gradient supportive banding provided in connection with the mechanical supportive banding; and performing heat dissipation functional area setting using motional heat and moisture analysis data, wherein types of the heat dissipation functional area comprise a perspiration transfer area, a moisture absorption and breathable area, a protective thermal buffering area and a thermal buffering area.

Optionally, constructing the corresponding relationship between the fabric functional area type information and knitting element information comprises:

constructing a corresponding relationship between the supportive banding and a first knitting element information, and a corresponding relationship between the gradient supportive banding and a second knitting element information, wherein the first knitting element information comprises information of one or any combination of a rib bundle stitch element, a missing stitch element, or a tuck stitch element, and the second knitting element information comprises information of one or any combination of a float plating stitch element, a combined element formed by alternative missing stitch and float plating stitch element, or a jacquard plating stitch element; and constructing a corresponding relationship between the perspiration transfer area and a third element information, a corresponding relationship between the moisture absorption and breathable area and a fourth element information, a corresponding relationship between the protective thermal buffering area and a fifth element information, and a corresponding relationship between the thermal buffering area and a sixth element information, the third element information comprises reticular mesh element information;

the fourth element information comprises information of the float plating stitch element and/or the jacquard plating stitch element;

the fifth element information comprises information of the missing stitch element and/or the combined element formed by alternative missing stitch and float plating stitch element and the sixth element information comprises information of the float plating stitch element and/or the jacquard plating stitch element.

Optionally, types of the supportive functional area further comprise an enhanced supportive area and an enhanced protective padding; and constructing a corresponding relationship between the fabric functional area type information and knitting element information comprises:

constructing a corresponding relationship between 1) the enhanced supportive area and the enhanced protective padding and 2) a seventh element information which comprises information of a missing stitch element with adjustable tensile compactness and/or a rib bundle stitch element with adjustable compressibility.

Optionally, providing the enhanced supportive area and the enhanced protective padding at positions corresponding to parts vulnerable in motion and soft tissues prone to vibration in motion comprises:

providing the enhanced supportive area and the enhanced supportive padding in areas corresponding to abdominal muscles, an iliopsoas muscle, a lateral latissimus dorsi muscle, muscles in back shoulders and elbows of an upper body, and in areas corresponding to a preabdomen, a lower back, lower buttocks and patellas of a lower body, respectively.

A fabric manufacturing control device is provided, which comprises a controller and a memory, wherein the controller is configured for performing fabric functional area setting using human morphology information, biomechanical analysis data on kinetic and kinematic, and heat and moisture analysis data, wherein the information of the fabric functional area setting comprises fabric functional area type information;

constructing a corresponding relationship between the fabric functional area type information and knitting element information which comprises knitting stitch structure information and knitting action information; and generating control instructions carrying the knitting stitch structure information and the knitting action information, and instructing integrated forming and seamless knitting of the fabric according to the knitting stitch structure information and the knitting action information; and wherein the memory is connected with the controller via an interface, and the memory is configured for storing information of the fabric functional area setting, the corresponding relationship between the fabric functional area type information and the knitting element information, and the control instructions carrying the knitting stitch structure information and the knitting action information.

A fabric manufacturing system is provided, which comprises a fabric manufacturing control device and a seamless fabric manufacturing device, wherein:

the fabric manufacturing control device comprises a controller and a memory, wherein the controller is configured for performing fabric functional area setting using human morphology information, biomechanical analysis data on kinetic and kinematic, and heat and moisture analysis data, wherein the information of the fabric functional area setting comprises fabric functional area type information;

constructing a corresponding relationship between the fabric functional area type information and knitting element information which comprises knitting stitch structure information and knitting action information; and generating control instructions carrying the knitting stitch structure information and the knitting action information, and instructing integrated forming and seamless knitting of the fabric according to the knitting stitch structure information and the knitting action information; and wherein the memory is connected with the controller via an interface, and the memory is configured for storing information of the fabric functional area setting, the corresponding relationship between the fabric functional area type information and the knitting element information, and the control instructions carrying the knitting stitch structure information and the knitting action information; and the seamless fabric manufacturing device comprises a control device for the seamless fabric manufacturing device and a seamless fabric knitting apparatus, wherein the control device for the seamless fabric manufacturing device is adapted to obtain information of fabric functional area setting performed using human morphology information, biomechanical analysis data on kinetic and kinematic, and heat and moisture analysis data, and call a corresponding relationship between the fabric functional area type information and the knitting element information; and the seamless fabric knitting apparatus is adapted to perform integrated forming and seamless knitting of the fabric according to the control instructions corresponding to the knitting stitch structure information and the knitting action information.

It can be seen from the above technical solutions that, according to the fabric manufacturing method of embodiments of the present disclosure, the fabric protection area setting is performed based on human morphology, biomechanical analysis data on kinetic and kinematic, and heat and moisture analysis results, different types of protection areas correspond to different knitting elements to meet the needs of mechanical protection of the musculoskeletal groups in the corresponding protective areas and human body heat dissipation. Integrated forming and seamless knitting are adopted to ensure the ductility, perspiration transfer, and moisture absorption of the fabric while requirements of mechanical support, stability and protection for kinetic muscular groups and vulnerable parts in human body are satisfied. Irritating sensation in wear caused by the seams in the prior art is avoided. Therefore, the technical effects of strengthening the protection effect of the fabric on dynamic human bodies and improving the ductility and wearing comfort of the fabric are achieved.

BRIEF DESCRIPTION OF THE DRAWINGS

In order to illustrate the technical solutions according to the embodiments of the present invention or those in the prior art more clearly, drawings to be used in the description of the prior art or the embodiments of the present application will be briefly described below. Apparently, the drawings described hereinafter are only some embodiments of the present invention, and other drawings can be obtained by those skilled in the art according to those drawings without creative efforts.

DETAILED DESCRIPTION OF THE EMBODIMENTS

The technical solutions in the embodiments of the present invention will be described clearly and completely hereinafter in conjunction with the drawings in the embodiments of the present invention. Apparently, the described embodiments are only a part but not all of the embodiments of the present invention. All the other embodiments can be obtained by those skilled in the art without creative efforts on the basis of the embodiments of the present invention, which fall within the scope of protection of the present invention.

According to an embodiment of the present invention, there is provided a fabric manufacturing method, a manufacturing control method, a manufacturing control device and a manufacturing system to achieve local and systemic mechanical support and moisture absorption and perspiration transfer function of a fabric, thereby achieving the technical effects of strengthening the protective effect of the fabric on dynamic human bodies and improving the ductility and wearing comfort of the fabric.

Figure 1A:
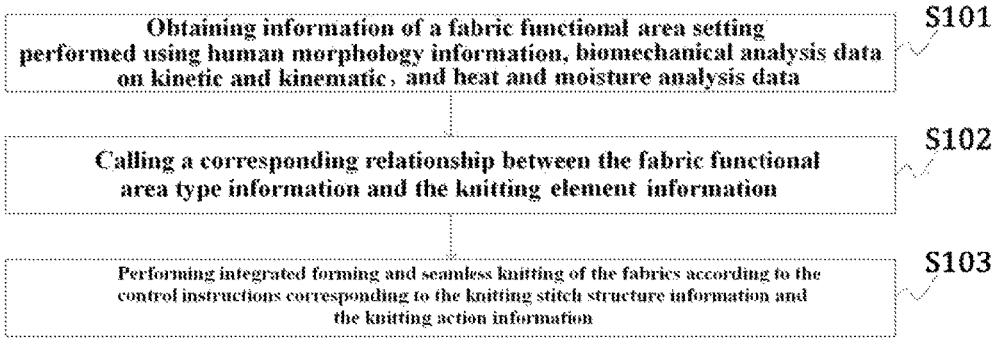
FIG. 1*a* is a flow chart of a fabric manufacturing method according to an embodiment of the present invention.
Figure 1B:
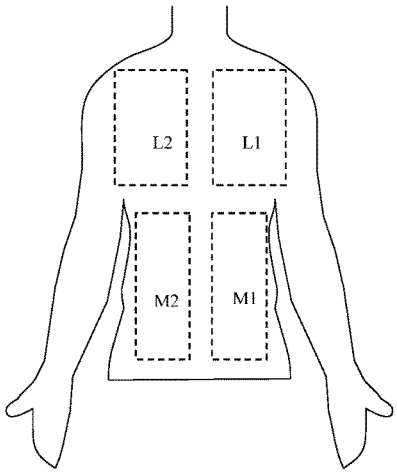
FIG. 1*b* to FIG. 1*e* are schematic structural diagrams of fabrics of an upper body according to an embodiment of the present invention.
Figure 1C:
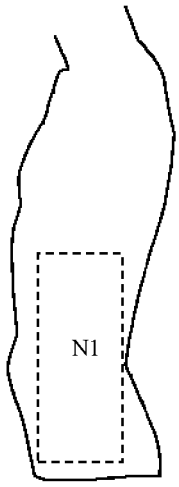
Figure 1D:
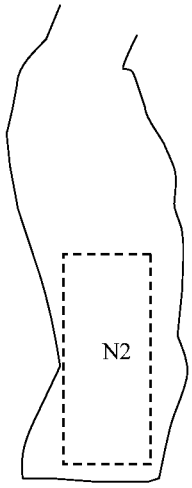
Figure 1E:
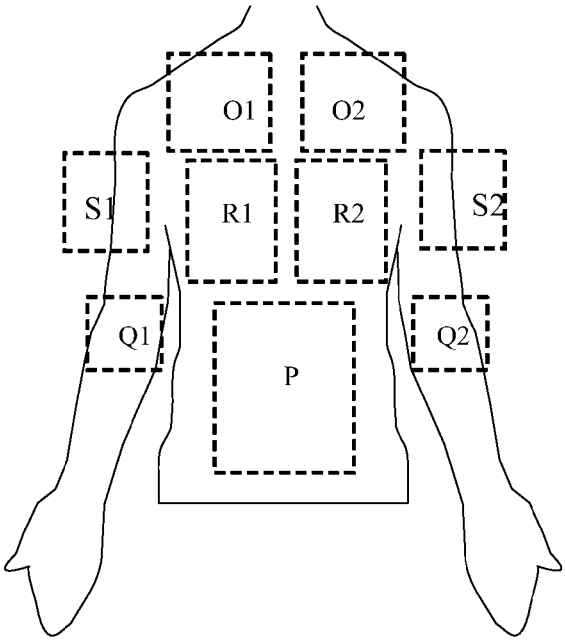
Figure 1F:
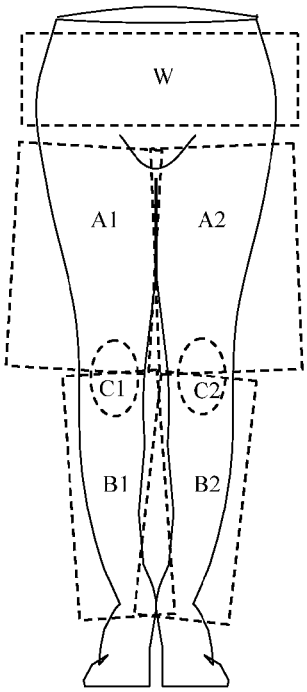
FIG. 1*f* to FIG. 1*i* are schematic structural diagrams of fabrics of a lower body according to an embodiment of the present invention.
Figure 1G:
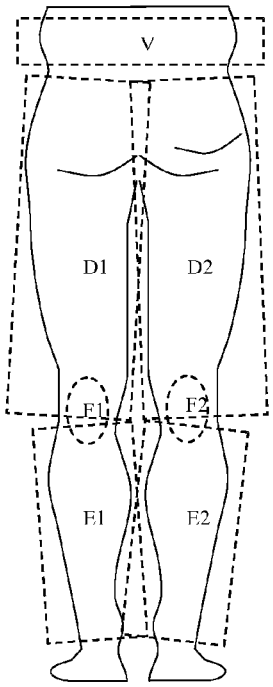
Figure 1H:
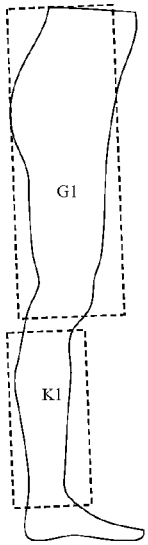
Figure 1I:
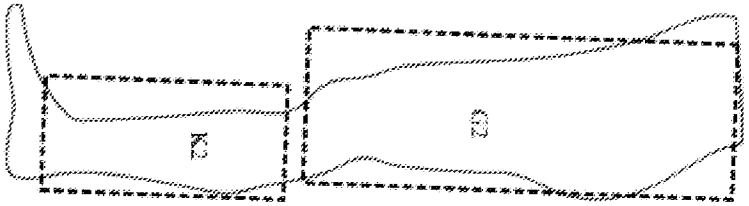

A fabric manufacturing method is illustrated in FIG. 1*a*, which comprises the following steps S101 to S103.

S101: obtaining information of a fabric functional area setting performed using human morphology information, biomechanical analysis data on kinetic and kinematic, and heat and moisture analysis data, wherein the information of the fabric functional area setting comprises fabric functional area type information.

The above step may be implemented as follows:

obtaining information of supportive functional area setting generated using human muscular group distribution information and biomechanical analysis data on kinetic muscular groups, wherein types of the supportive functional area comprise a reticular mechanical supportive banding group provided at positions corresponding to major kinetic muscular groups, and a gradient supportive banding provided in connection with the mechanical supportive banding; and obtaining information of heat dissipation functional area setting generated using motional heat and moisture analysis data, wherein types of heat dissipation functional area comprise a perspiration transfer area, a moisture absorption and breathable area, a protective thermal buffering area and a thermal buffering area.

For the sake of clear description and enablement, description is made in conjunction with FIG. 1*b* to FIG. 1*i*.

Human morphology information comprises human construction information and muscular group distribution of the upper body and the lower body, as shown in FIG. 1*b* to FIG. 1*e*.

Supportive areas at the upper body are mainly provided at 15 blocks which are divided into 8 groups, including a chest L (a left block L1 and a right block L2) and an abdomen M (a left block M1 and a right block M2) of the front body; a side body N (a left block N1 and a right block N2); a shoulder O (a left block O1 and a right block O2), a middle back R (a left block R1 and a right block R2), a lower back P, the middle portion of upper arms S (a left block S1 and a right block S2) and elbows Q at the back of arms (a left block Q1 and a right block Q1) of the back body.

As shown in FIG. 1*f* to FIG. 1*i*, supportive areas at lower limbs of a human body are mainly provided at 18 blocks which are divided into 10 groups, including an abdomen W, a lower back V, the front of thighs A (a right block A1 and a left block A2), the front of calves B (a right block B1 and a left block B2), the back of thighs D (a left block D1 and a right block D2), the back of calves E (a left block E1 and a right block E2), knees C (a right block C1 and a left block C2), popliteal fossas F (a left block F1 and a right block F2), lateral sides of thighs G (a right block G1 and a left block G2), and lateral sides of calves K (a right block K1 and a left block K2). The supportive areas are connected orderly according to muscular distribution and orientation to form a systematic "reticular" supportive and protective system.

Figure 2A:
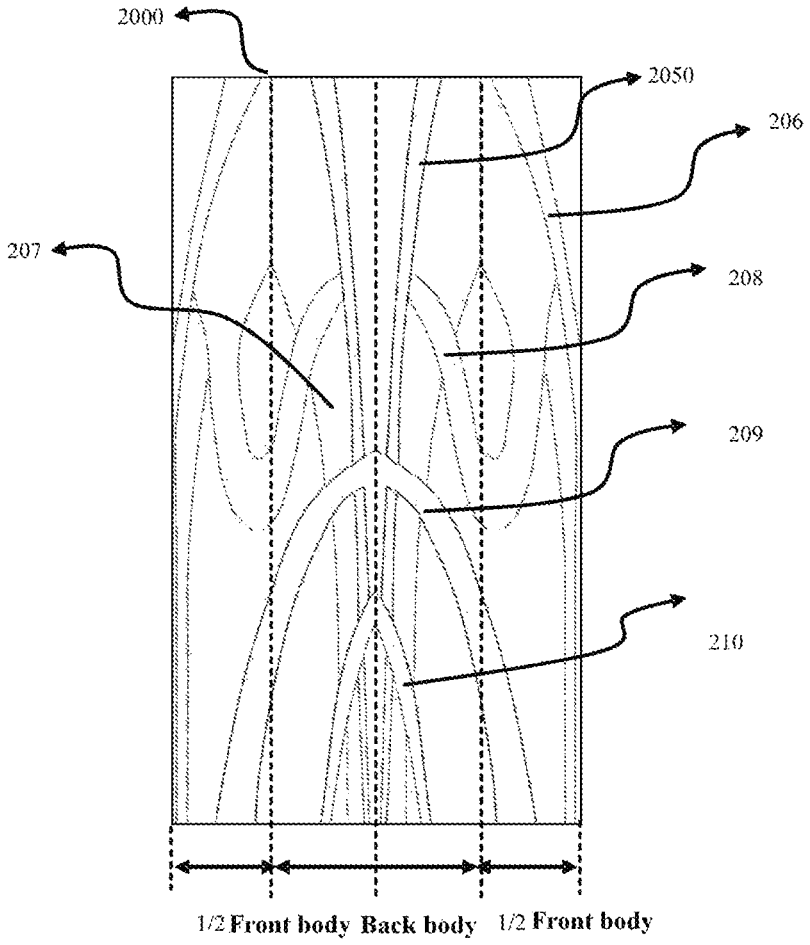
FIG. 2*a* is a schematic structural diagram of mechanical supportive banding groups on a front body and a back body of an upper limb according to an embodiment of the present invention.
Figure 2B:
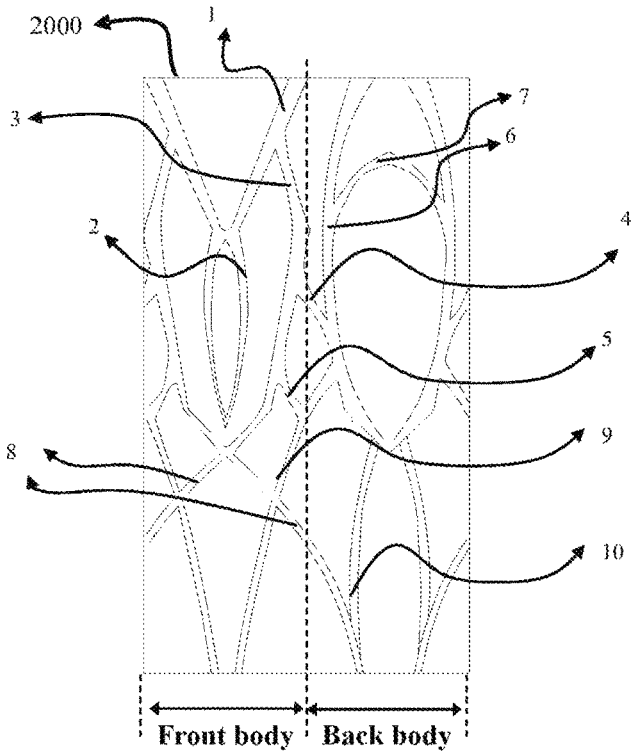
FIG. 2*b* is a schematic diagram of a manufacturing and forming position of mechanical supportive banding groups of a lower body according to an embodiment of the present invention.

The manufacturing and forming positions of the mechanical supportive banding group 2000 provided at positions corresponding to major kinetic muscular groups are described in conjunction with FIG. 2*a* to FIG. 2*c*.

FIG. 2*a* is a schematic diagram of an unfolded upper body garment with front and back view. An first upper limb supportive banding 2050, which extends from the block O at the upper back where the trapezius muscle locates along the spine downward to the end of block P at the lower back where the lumbodorsal fascia locates, is formed longitudinally across the back. This supportive banding is connected with a fourth lateral upper limb supportive banding 208 located at the shoulder O block, the middle back R block and the lower back P block, a fifth lateral upper limb supportive banding 209 located at the lower back P block, and a sixth lateral upper limb supportive banding 210 located at the lower back P block respectively to form a reticular support system. The fourth lateral supportive banding 208 located at the lower back P block transversely goes across back shoulders and extends to the front chest L block along the armhole under the armpit to form a supportive area which covers infraspinatus muscle, serratus anterior muscle, and pectoralis major muscle, thereby the stability of the muscular groups related to stretching movement of the upper limbs and scapula movement is enhanced. The fifth upper limb supportive banding 209 crossing the middle back R (a left block R1 and a right block R2) extends from the back to the abdomen M (a left block M2 and a right block M1) of the front body along an arch-shaped curve in accordance with the body curve, covers the latissimus dorsi muscle and a part of the rectus abdominis muscle, and supports the upper body, especially the back with a continues and ordered support network in coordination with the sixth upper limb supportive banding 210 which is located at the lower back P block and covers the lumbodorsal fascia, thereby the excessive stretching and vibration of the muscle in motion is reduced and the possibly resulted macular group pain and damage are prevented. Further, a wider third upper limb supportive banding 207 is provided which parallels to the first upper limb supportive banding 2050, starts form the fourth upper limb supportive banding 208, connects to the fifth upper limb supportive banding 209 and the sixth upper limb supportive banding 210, and ends at a lower hem of the back body of the top to further support the middle back and the lower back.

In addition, a second upper limb supportive banding 206 longitudinally crossing the front body is formed which starts from the upper end of the chest L block through the abdomen to the lower end of the M block, coordinates with the first upper limb supportive banding 2050 longitudinally crossing the back, to form a longitudinal systematic mechanical support of the upper body. In view of dynamic comfort and visual aesthetics, the width of the supportive banding may vary in different areas. For example, the supportive banding may be wider at positions near the chest, the shoulder and the middle back, with the maximum width being 8 to 14 cm; whereas the longitudinal supportive banding is relatively narrower, with the width being about 2 to 4 cm.

FIG. 2*b* is a schematic diagram of an unfolded fabric of a lower body, (here, the fabric design for a left leg is taken as an example) including the following parts. A first lower limb supportive banding 1 is formed which extends along the rectus abdominis muscle at the abdomen W block down to the groin, with its middle part and end connected to a second lower limb supportive banding 2 and a third lower limb supportive banding 3 which are formed along a quadriceps femoris muscle and a sartorius muscle at the block A2 of the front of the thighs, respectively. The third lower limb supportive banding 3 provided at the block A2 extends downward to the medial side of the patella at the block C2. Two extensible fourth lower limb supportive bandings 4 and a fifth lower limb supportive bandings 5 are provided at the block G2 which cover and wrap the iliotibial tract of the fascia lata, go along and connect to the third lower limb supportive banding 3. A sixth lower limb supportive banding 6 is formed which extends upward from hamstrings at the back of the thigh (block D1) to the gluteus maximus muscle and connects to the fourth lower limb supportive bandings 4 and a fifth lower limb supportive bandings 5, respectively. Meanwhile, the sixth lower limb supportive banding 6 continuously extends upward to the lower back V, and connects to a seventh lower limb supportive banding 7 which goes by the gluteus maximus muscle and stabilizes the middle gluteal muscle. Design of the above combined supportive bandings forms a continuous reticular supportive banding system at major kinetic muscular groups such as the waist and abdomen, the hip and the upper part of the thigh.

Another continuous reticular supportive system including the following parts is also formed at the calf, which connects to the reticular supportive banding of the thigh and goes by the knee C block. An eighth lower limb supportive banding 8 extends downward from the third lower limb supportive banding 3 at the block A2 and covers the block B and the block E (the tibialis anterior muscle and the gastrocnemius muscle of the calf). A ninth lower limb supportive banding 9 extends downward form the sixth lower limb supportive banding 6 and covers the gastrocnemius muscle at the inner side of the block B2 at the front of the calf. And a tenth lower limb supportive banding 10 longitudinally goes across the gastrocnemius muscle at the posterior side of the calf (the block E1). These supportive banding branches form a reticular supportive banding system providing support for force bearing muscular groups at a plurality of blocks from various angles to stabilize the motion amplitude of muscles and prevent damage.

The forms and positions for manufacturing and forming the gradient supportive banding are illustrated in conjunction with FIG. 3*a* to FIG. 3*e*.

Figure 3A:
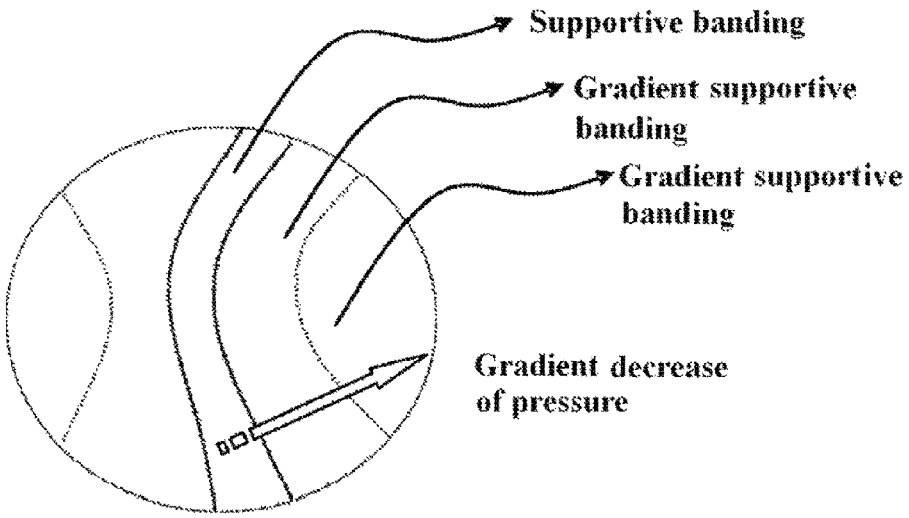
FIG. 3*a* is a schematic diagram of a distribution relationship between a supportive banding and a gradient supportive banding according to an embodiment of the present invention.

A "secondary pressure" system is provided near the supportive banding with a higher pressure to form a transnational gradient mechanical supportive functional area, thereby discomfort irritation caused by local high pressure on skin and tissues, as well as the possibly resulted swelling and blood circulation issue can be avoided. The gradient supportive banding is seamlessly connected with the supportive banding. The support pressure decreases progressively from the supportive banding to the gradient supportive banding. The distribution relationship between the supportive banding and the gradient supportive banding is shown in FIG. 3*a*. Since the gradient supportive banding not only has less pressure and tightness than the supportive banding, but also has better air permeability because of the structure of float plating stitch, the wearing pressure perception and thermal comfort of compressed skin surface are improved.

Manufacturing and forming positions of the supportive banding and the gradient supportive banding of the top and the bottom of a tight fitting compression garment are shown in FIG. 3*b* to FIG. 3*e*.

At the front of the top (FIG. 3*b*), a first upper limb gradient supportive banding 160 is formed near the seventh upper limb supportive banding 211.

At the back of the top (FIG. 3*c*), a second upper limb gradient supportive banding 180 and a third upper limb gradient supportive banding 170 are formed near the third supportive padding 13.

At a sleeve (FIG. 3*d*), a fourth upper limb gradient supportive banding 190 and a fifth upper limb gradient supportive banding 200 are formed near the eighth upper limb supportive banding 212.

At the front of the thigh (FIG. 3*e*), a first lower limb gradient supportive banding 140, a second lower limb gradient supportive banding 100 and a third lower limb gradient supportive banding 90 are formed near the third lower limb supportive banding 3; a fourth lower limb gradient supportive banding 110 and the third lower limb gradient supportive banding 90 are formed near the first lower limb supportive banding 1 located at a intestinal psoas muscle of the front abdomen; and a fifth gradient supportive banding 130 and a sixth gradient supportive banding 120 are formed near the seventh lower limb supportive banding 7 through the gastrocnemius muscle at the calf B block.

At the back of the thigh (FIG. 3*f*), a seventh lower limb gradient supportive banding 40 and a eighth lower limb gradient supportive banding 30 are formed near the upper end of the sixth supportive banding 6 and extend from the third lower limb supportive banding 3 towards block Dl at the back of the thigh; a ninth lower limb gradient supportive banding 60 and a tenth lower limb gradient supportive banding 50 are formed near the lower end of the sixth lower limb supportive banding 6 at the block D of the back of the thigh; and a eleventh lower limb gradient supportive banding 80 and a twelfth lower limb gradient supportive banding 70 are formed near the eighth lower limb supportive banding 8 on the gastrocnemius muscle at the back of the calf.

S102: calling a corresponding relationship between the fabric functional area type information and the knitting element information, which comprises:

calling a corresponding relationship between the supportive bandings and a first knitting element information, and a corresponding relationship between the gradient supportive bandings and a second knitting element information, wherein the first knitting element information comprises information of one or any combination of a rib bundle stitch element, a missing stitch element, and a tuck stitch element; and the second knitting element information comprises information of one or any combination of a float plating stitch element, a combined element formed by alternative missing stitch and float plating stitch element, or a jacquard plating stitch element, wherein a three-dimensional seamless rib bundle stitch with high density and low stretchability is adopted as the supportive banding to achieve sufficient mechanical support and morphological stability. The reticular supportive banding system is seamlessly knitted with the other parts of the fabric, which increases wearing integration and stretch comfort of the clothing. The interface pressure applied by major supportive bandings to the skin is between about 1200 to 2500 pascal, which is within the comfortable pressure range for human; and the gradient supportive bandings not only have a less pressure and tightness compared to the major supportive bandings, but also have better air permeability because of the structure of float plating stitches, and thus the wearing pressure perception and thermal comfort of the compressed skin surface are improved; and calling a corresponding relationship between the perspiration transfer area and a third element information, a corresponding relationship between the moisture absorption and breathable area and a fourth element information, a corresponding relationship between the protective thermal buffering area and a fifth element information, and a corresponding relationship between the thermal buffering area and a sixth element information, wherein the third element information comprises reticular mesh element information;

the fourth element information comprises information of the float plating stitch element and/or the jacquard plating stitch element;

the fifth element information comprises information of the missing stitch element and/or the combined element formed by alternative missing stitch and float plating stitch element; and the sixth element information comprises information of the float plating stitch element and/or the jacquard plating stitch element.

The artistic conception drawing for construction of the perspiration transfer area, the moisture absorption and breathable area, the protective thermal buffering area and the thermal buffering area are described in conjunction with FIG. 4*a* to FIG. 4*d,* and the application positions of the respective functional areas on the tight fitting compression garment are shown in FIG. 5*a* to FIG. 5*d.*

As can be taken as an example, the above knitting action information can be interpreted as follows.

The reticular mesh stitch refers to a fishnet or eyelet effect formed by adopting local knockover technique along with a plain plating stitch. In the float plating stitch, a face yarn is selectively involved in knitting according to requirements on the structure and pattern and takes the form of a floating thread when knitted, while a ground yarn participate in knitting at same time throughout the fabrication. In the missing stitch, the one or more knitting stitches in a weft plain course are selected to continuously stride over multiple transversal knitting courses to form a three-dimensional knitting structure with a discontinuous overlapped stitch effect.

Figure 4A:
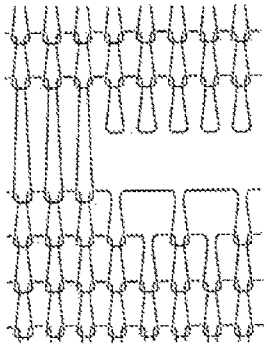
FIG. 4*a* to FIG. 4*d* are schematic diagrams of organizational structure and knitting design of heat dissipation functional area components according to an embodiment of the present invention.
Figure 5A:
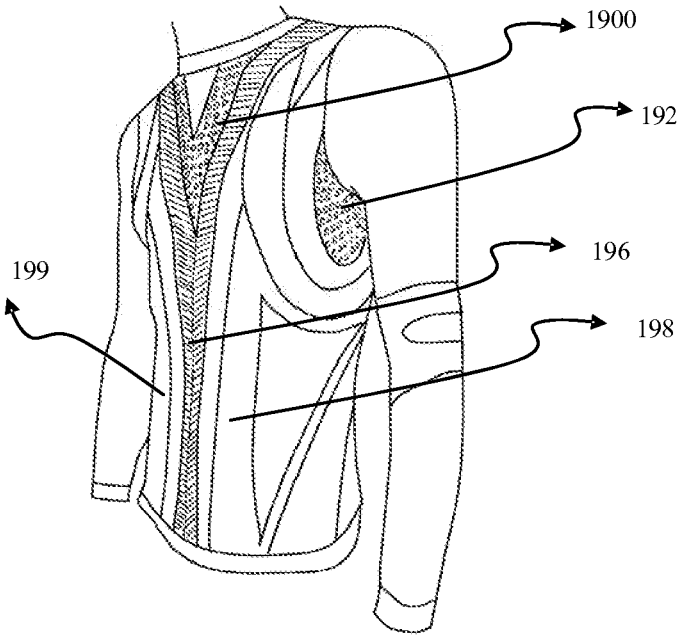
FIG. 5*a* to FIG. 5*d* are schematic diagrams of forming positions and application of a heat dissipation functional area according to an embodiment of the present invention.
Figure 5B:
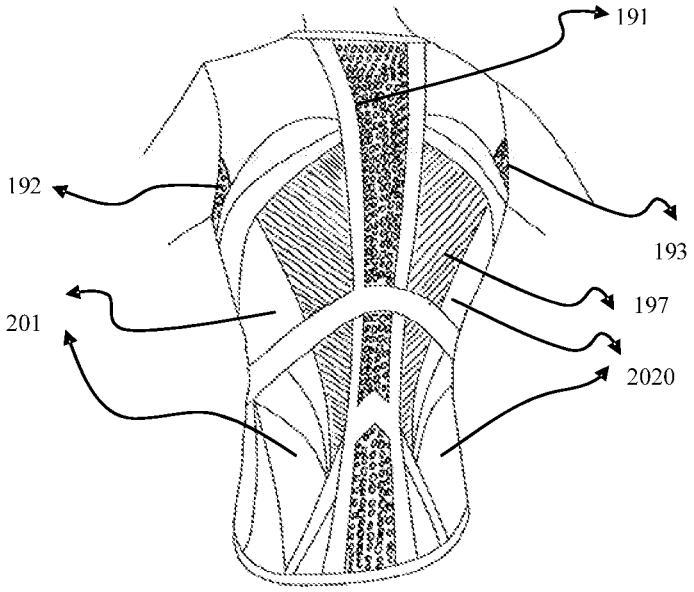
Figure 5C:
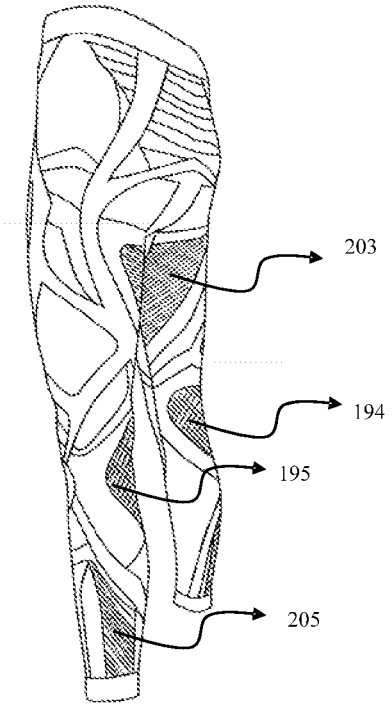
Figure 5D:
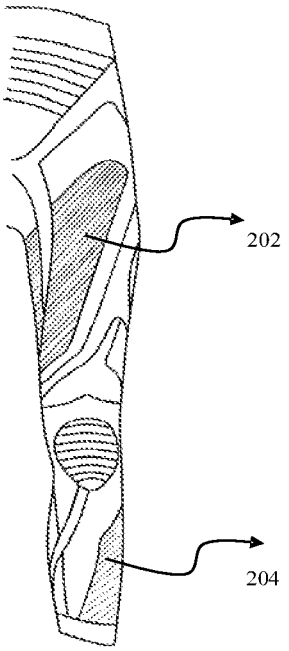

As shown in FIG. 4*a,* since the reticular mesh stitch has good air and moisture permeability, the perspiration transfer structure is applied at the chest 1900, the middle back 191, the left armpit 192 and the right armpit 193, as shown in FIG. 5*a* to FIG. 5*b.*

Figure 4B:
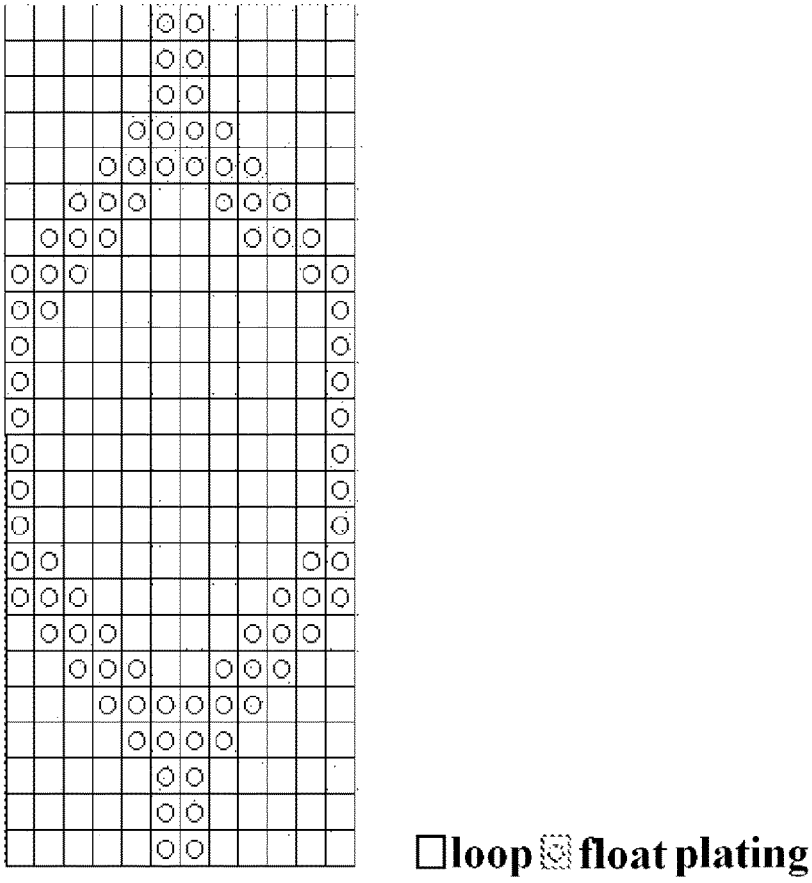

As shown in FIG. 4*b,* since the fabric with a cross-textured structure formed by the float plating stitch is light, thin and has good air permeability and perspiration transfer performance, it is provided at a first popliteal fossa F 194 and a second popliteal fossa F 195 to avoid the fabric from piling up at the back of the knee when the leg is bended and to improve local moisture and thermal regulation.

Figure 4C:
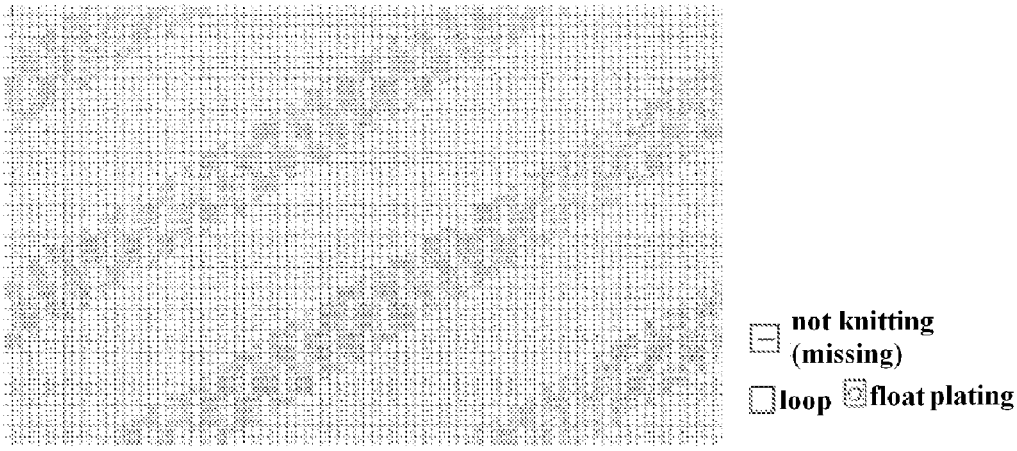

As shown in FIG. 4*c,* a fabric block formed by alternative missing stitch and float plating stitches, which has not only support and protection effect but also "thermal buffer" effect, is provided at the middle of the front abdomen 196, the latissimus dorsi muscle 197, the anterior thigh 202, the posterior thigh 203, the anterior calf 204 and the posterior calf 205 to improve thermal buffer for these parts, i.e. to prevent variation in ambient temperature from impacting on the body, and at the same time provide muscular groups with support and protection.

Figure 4D:
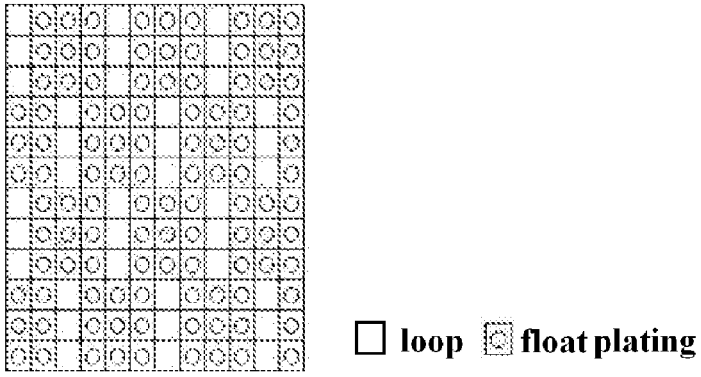

As shown in FIG. 4*d,* the "thermal buffering area" formed by the float plating stitch is provided at a first anterior abdomen part 198, a second anterior abdomen part 199, a first side back part 201 and a second side back part 2020. It has a thickness of less than that of the fabric in FIG. 4*c,* but has better air permeability, moisture permeability and stretchability, and thereby the overall wearing thermal-moisture comfort is improved.

All of the above fabric function blocks are seamlessly knitted, and when the integrated formed fabric structure is worn, stress adjustment such as adjustment of traction, shearing force and restoring force can be performed by itself with the changes in physical morphology without affecting wearing and using comfort, and thereby motional demands of the user can be met.

As may be taken as another example, types of the supportive functional area further comprise an enhanced supportive area and an enhanced protective padding provided at positions corresponding to parts vulnerable in motion and soft tissues prone to vibration in motion;

obtaining the corresponding relationship between the fabric functional area type information and the knitting element information comprises:

obtaining a corresponding relationship between 1) the enhanced supportive area and the enhanced protective padding and 2) a seventh element information which comprises information of the missing stitch element with adjustable tensile compactness and the rib bundle stitch element with adjustable compressibility.

Referring to FIG. 5*a* to FIG. 5*d,* the manufacturing and forming positions of the enhanced supportive area and the enhanced protective padding comprise:

two parallel arciform supportive bandings with gradually changing width from 5-9 cm to 2-4 cm extending downward from the blocks of the upper arms S covering deltoid muscles and peptide triceps muscles to the bottom of the sleeves are formed to support and protect muscles of the upper limb.

Figure 3B:
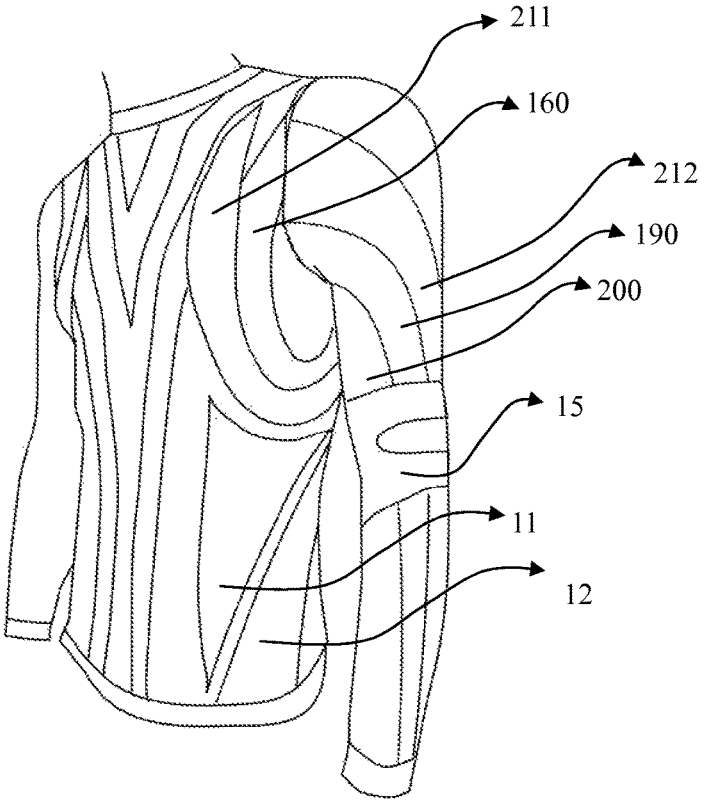
FIG. 3*b* to FIG. 3*d* are schematic diagrams of manufacturing and forming positions of a supportive banding, a gradient supportive banding, and an enhanced supportive area and enhanced supportive padding of the upper body according to an embodiment of the present invention.
Figure 3C:
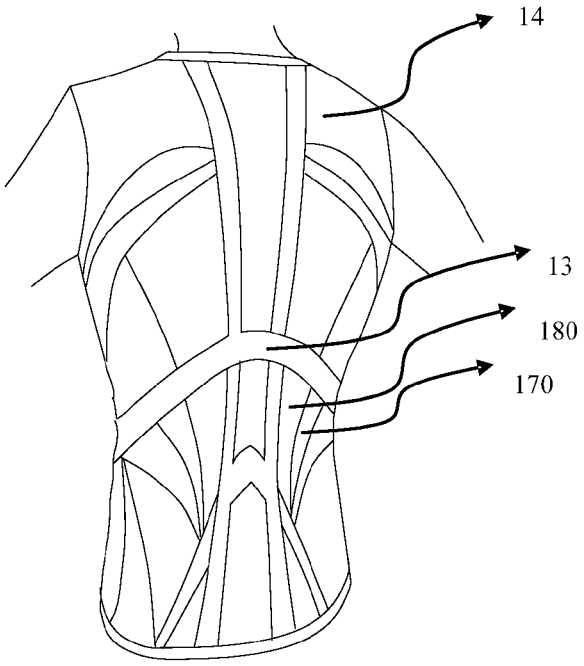
Figure 3D:
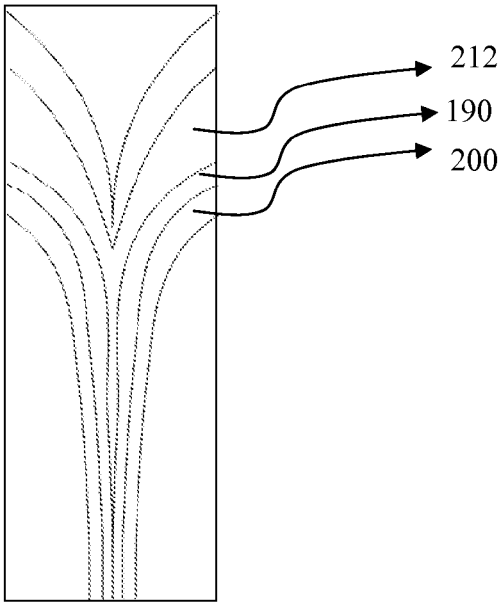
Figure 3E:
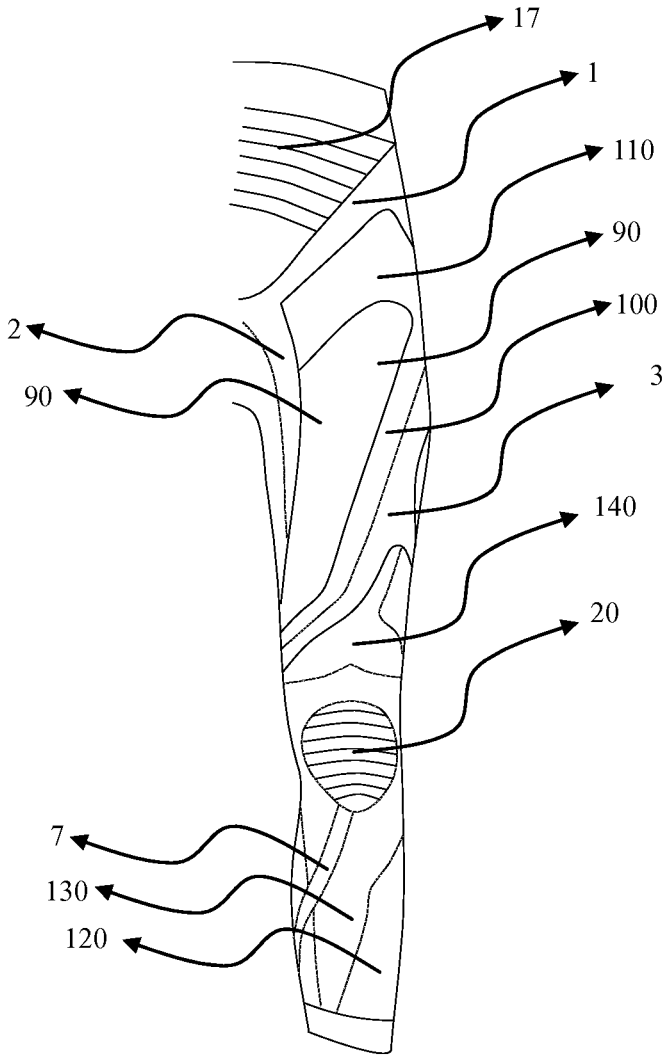
FIG. 3*e* to FIG. 3*f* are schematic diagrams of manufacturing and forming positions of a supportive banding, a gradient supportive banding, and an enhanced supportive area and enhanced supportive padding of the lower body according to an embodiment of the present invention.
Figure 3F:
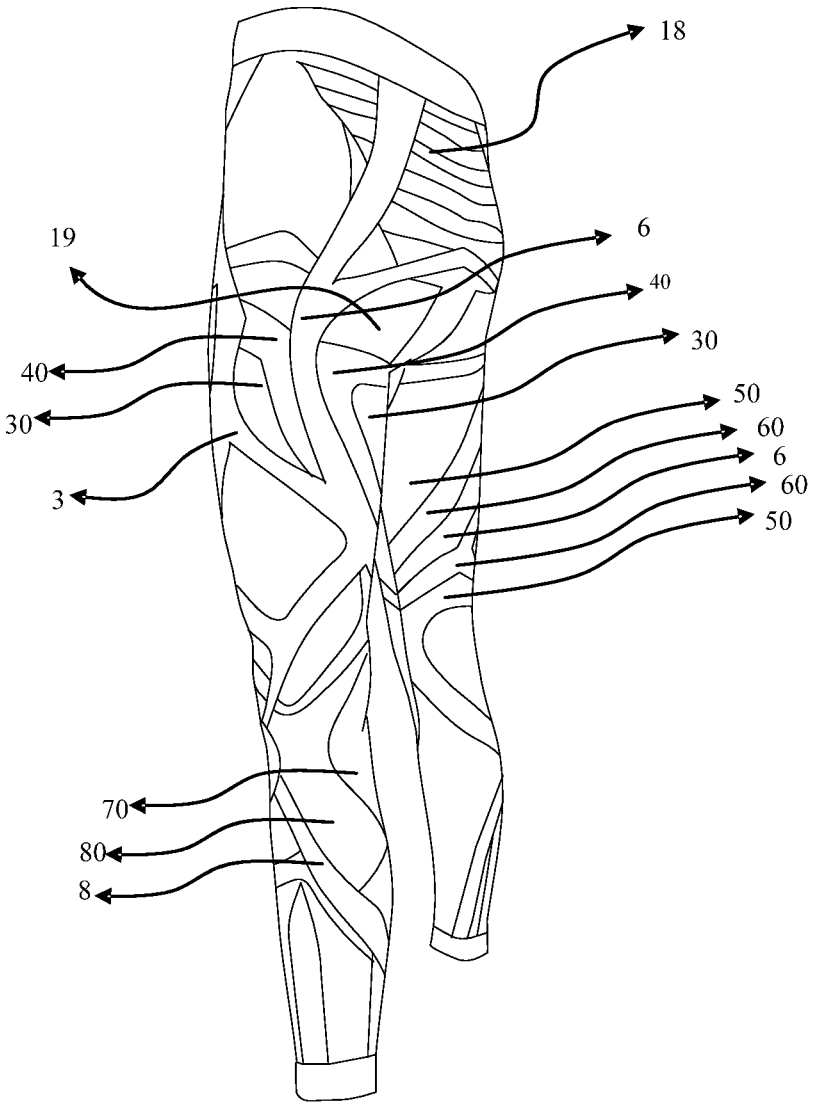

As shown in FIG. 3*b* to FIG. 3*c,* a first supportive padding 11, a second supportive padding 12, a third supportive padding 13 and a fourth supportive padding 14 are formed at the abdomen M, the side waist N, the middle back (the latissimus dorsi muscle) P and the back shoulder O in the upper body, respectively. The supportive padding has a tensile tightness similar to that of the supportive banding, but the supportive padding is thicker, and has better mechanical and thermal buffering properties. Furthermore, an enhanced protective padding 15 with a thickness of up to 7 mm is formed by a seamless three-dimensional missing stitch at elbow block Q and is seamlessly connected with the other fabrics of the upper body.

In addition, a first enhanced supportive area 17, a second enhanced supportive area 18 and a third enhanced supportive area 19 (referring to FIG. 3*e* to FIG. 3*f*) with low extension but good shape retention are formed by the three-dimensional missing stitch at the front abdomen W, the lower back V and the lower buttocks at the upper part of block D respectively in lower body to provide mechanical effects of hip lifting and abdomen in. A thicker enhanced supportive area and enhanced protective padding 20 with a thickness of up to 8 mm is formed at the patella C by a more compact three-dimensional missing stitch. The enhanced supportive area and enhanced protective padding is provided exactly at the intersection of the eighth lower limb supportive banding 8 and the ninth lower limb supportive banding 9, and connected naturally and seamlessly with the reticular supportive banding.

Steps S101 and S102 are performed by a control device in the seamless fabric manufacturing device to obtain required information and call the corresponding relationship in integrated forming and seamless knitting, thereby the seamless fabric knitting apparatus is prepared for finish knitting.

S103: performing integrated forming and seamless knitting of the fabrics according to the control instructions corresponding to the knitting stitch structure information and the knitting action information.

The knitting action information comprises timing and action requirements during fabric manufacturing of the seamless knitting device. The knitting action information can be interpreted as a set of knitting actions of the seamless knitting device corresponding to patterns generated based on settings of the fabric functional area.

The integrated forming and seamless knitting of the fabric is performed using superfine polyester functional yarn and polyamide elastic covering yarn according to the knitting stitch structure information and the knitting action information. The knitting material of the fabric is not limited to the above mentioned polyester and polyamide fiber, and can also be other natural fiber, artificial fiber, synthetic fiber or functional yarn suitable for knitting.

It should be further noted that, the superfine polyester functional yarn takes polyester fiber as a carrier, and the cross section of the fiber is a superfine engineering designed combined structure consisting of multi-channel grooves and hollow structure. This special structure can not only improve the wicking behavior of the fabric on sweat and moisture (moisture absorption and sweat transfer), but also dynamically adjust the thermal equilibrium and improve the thermal protection and thermal buffering properties of the fabric. Additionally, the fabric can provide more light, soft and comfortable perception because of the superfine hollow structure. The fabric is knitted by 75 denier of the above described superfine polyester functional yarn and 20 denier of polyamide elastic covering yarn.

It should be noted that, the manufacturing and forming positions in FIG. 1*b* to FIG. 1*i* and FIG. 2 to FIG. 4 are provided for reference only and not for limitation, and the divided areas and each area are not limited to the division manner illustrated in the drawings.

It can be known that the fabric manufacturing method can be applied in the knitting of the top, the bottom, one piece, and partial fabrics for human body, bodyshape garment, and medical fabrics, and is not limited to a certain type of fabrics.

Figure 6:
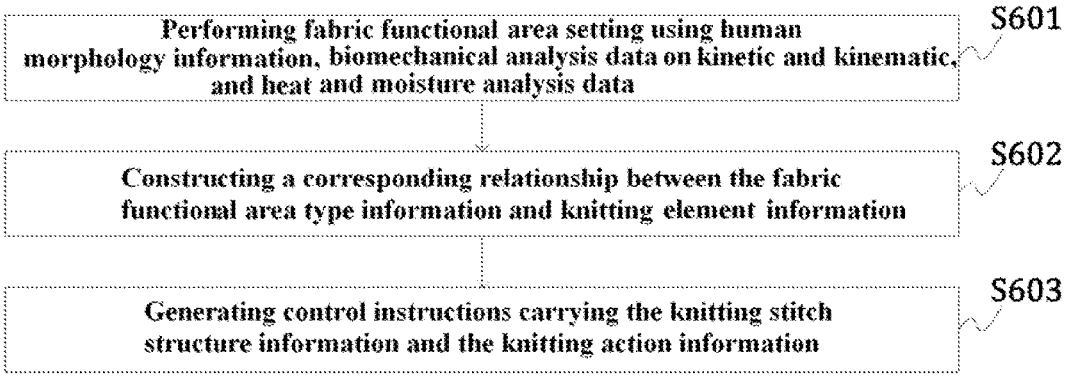
FIG. 6 is a flow chart of a fabric manufacturing control method according to an embodiment of the present invention.

A fabric manufacturing control method is shown in FIG. 6, which comprises the following steps S601 to S603.

S601: performing fabric functional area setting using human morphology information, biomechanical analysis data on kinetic and kinematic, and heat and moisture analysis data, wherein the information of the fabric functional area setting comprises fabric functional area type information;

Preferably, in this step:

performing supportive functional area setting using human muscle group distribution information and biomechanical analysis data on kinetic muscular groups, wherein types of the supportive functional area comprise a reticular mechanical supportive banding group provided at positions corresponding to major kinetic muscular groups, and a gradient supportive banding provided in connection with the mechanical supportive banding; and performing heat dissipation functional area setting using motional heat and moisture analysis data, wherein types of the heat dissipation functional area comprise a perspiration transfer area, a moisture absorption and breathable area, a protective thermal buffering area and a thermal buffering area.

S602: constructing a corresponding relationship between the fabric functional area type information and knitting element information which comprises knitting stitch structure information and knitting action information.

Step S602 can be implemented as follows:

constructing the corresponding relationship between the fabric functional area type information and the knitting element information, which comprises:

constructing a corresponding relationship between the supportive banding and a first knitting element information, and a corresponding relationship between the gradient supportive banding and a second knitting element information, wherein the first knitting element information comprises information of one or any combination of a rib bundle stitch element, a missing stitch element, or a tuck stitch element, and the second knitting element information comprises information of one or any combination of a float plating stitch element, a combined element formed by alternative missing stitch and float plating stitch element, or a jacquard plating stitch element; and constructing a corresponding relationship between the perspiration transfer area and a third element information, a corresponding relationship between the moisture absorption and breathable area and a fourth element information, a corresponding relationship between the protective thermal buffering area and a fifth element information, and a corresponding relationship between the thermal buffering area and a sixth element information, the third element information comprises reticular mesh element information;

the fourth element information comprises information of the float plating stitch element and/or the jacquard plating stitch element;

the fifth element information comprises information of the missing stitch element and/or the combined element formed by alternative missing stitch and float plating stitch element; and the sixth element information comprises information of the float plating stitch element and/or the jacquard plating stitch element. Types of the supportive functional area further comprise an enhanced supportive area and an enhanced protective padding.

S602: constructing a corresponding relationship between 1) the enhanced supportive area and the enhanced protective padding and 2) a seventh element information which comprises information of a missing stitch element with adjustable tensile compactness and/or a rib bundle stitch element with adjustable compressibility.

S603: generating control instructions carrying the knitting stitch structure information and the knitting action information, and instructing integrated forming and seamless knitting of the fabric according to the knitting stitch structure information and the knitting action information.

According to the method, the seamless fabric manufacturing device is controlled to perform fabric manufacturing.

Processes and instructions corresponding to the method can be performed by a computer which controls the seamless fabric knitting apparatus. The implementation of the manufacturing method illustrated in FIG. 1*a* and the corresponding description can be interpreted as: after setting of fabric functional areas, construction of corresponding relationships and generation of control instructions are finished in the computer, the fabric functional areas, the corresponding relationships and the control instructions are transmitted to the control device of the seamless fabric manufacturing device to perform the control method according to the present example.

Figure 7:
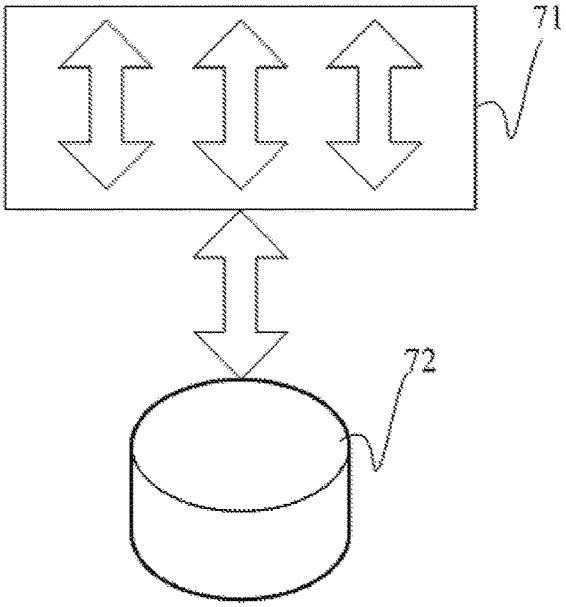
FIG. 7 is a schematic structural diagram of a fabric manufacturing control device according to an embodiment of the present invention.

A fabric manufacturing control device is shown in FIG. 7, which comprises:

a controller 71 and a memory 72, wherein the controller 71 is configured for performing fabric functional area setting using human morphology information, biomechanical analysis data on kinetic and kinematic, and heat and moisture analysis data, wherein the information of the fabric functional area setting comprises fabric functional area type information;

constructing a corresponding relationship between the fabric functional area type information and the knitting element information which comprises knitting stitch structure information and knitting action information; and generating control instructions carrying the knitting stitch structure information and the knitting action information, and instructing integrated forming and seamless knitting of the fabric according to the knitting stitch structure information and the knitting action information; and wherein the memory 71 is connected with the controller 72 via an interface, and the memory is configured for storing information of the fabric functional area setting, the corresponding relationship between the fabric functional area type information and the knitting element information, and the control instructions carrying the knitting stitch structure information and the knitting action information.

The control device can be interpreted as a computer, or an intelligent terminal with control function, such as a tablet. The control device performs online or offline control on the seamless fabric manufacturing device.

Figure 8:
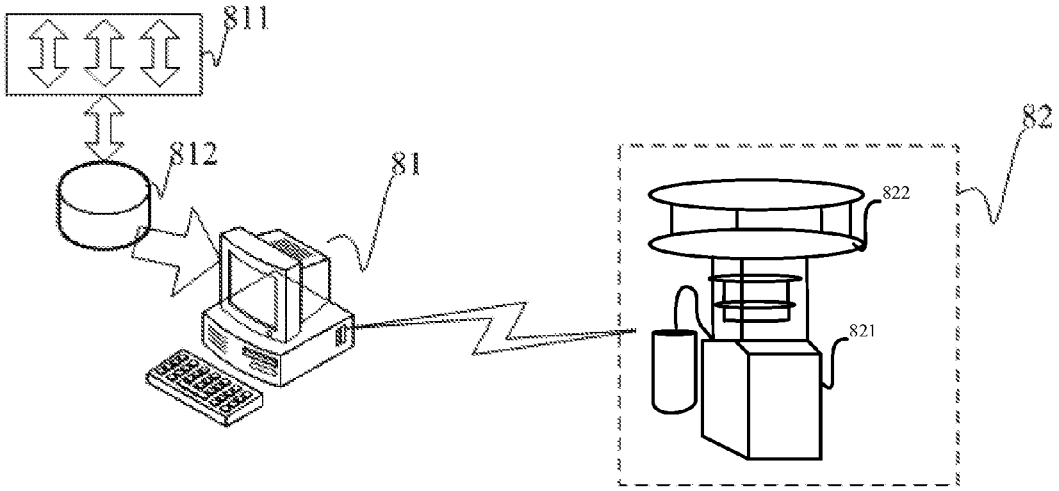
FIG. 8 is a schematic structural diagram of a fabric manufacturing system according to an embodiment of the present invention.

A fabric manufacturing system, a fabric manufacturing control device 81 and a seamless fabric manufacturing device 82 are shown in FIG. 8, wherein:

the fabric manufacturing control device 81 comprises a controller 811 and a memory 812, wherein the controller is configured for performing fabric functional area setting using human morphology information, biomechanical analysis data on kinetic and kinematic, and heat and moisture analysis data, wherein the information of the fabric functional area setting comprises fabric functional area type information;

constructing a corresponding relationship between the fabric functional area type information and the knitting element information which comprises knitting stitch structure information and knitting action information; and generating control instructions carrying the knitting stitch structure information and the knitting action information, and instructing integrated forming and seamless knitting of the fabric according to the knitting stitch structure information and the knitting action information; and wherein the memory is connected with the controller via an interface, and the memory is configured for storing information of the fabric functional area setting, the corresponding relationship between the fabric functional area type information and the knitting element information, and the control instructions carrying the knitting stitch structure information and the knitting action information; and the seamless fabric manufacturing device 82 comprises a control device 821 for the seamless fabric manufacturing device and a seamless fabric knitting apparatus 822, wherein the control device 821 for the seamless fabric manufacturing device is adapted to obtain information of fabric functional area setting performed using human morphology information, biomechanical analysis data on kinetic and kinematic, and heat and moisture analysis data; and call a corresponding relationship between the fabric functional area type information and the knitting element information; and the seamless fabric knitting apparatus 822 is adapted to perform integrated forming and seamless knitting of the fabric according to the control instructions corresponding to the knitting stitch structure information and the knitting action information.

The seamless fabric knitting apparatus can be implemented by an electronic seamless circular knitting machine.

The fabric manufacturing control device 81 is a control device, while the seamless fabric manufacturing device 82 is a controlled device which is provided with a processing unit, i.e. the control device 821 of the seamless fabric manufacturing device. After setting of fabric functional areas, construction of corresponding relationships and generation of control instructions are finished by the fabric manufacturing control device 81, the fabric functional areas, the corresponding relationships and the control instructions are transmitted to the control device 821 of the seamless fabric manufacturing device to perform the control method, and integrated forming and seamless knitting of the fabric are performed by the seamless fabric knitting apparatus 822.

In summary, according to the fabric manufacturing method of embodiments of the present disclosure, the fabric protection area setting is performed based on human morphology, biomechanical analysis on kinetic and kinematic and heat and moisture analysis results, different types of protection areas correspond to different knitting elements to meet the needs of mechanical protection of the muscular group in the corresponding protection area and human body heat dissipation. Integrated forming and seamless knitting are adopted to ensure the ductility and moisture absorption and perspiration transfer of the fabric while requirements of mechanical support, stability and protection for kinetic muscular groups and vulnerable parts in human body are satisfied. Irritating sensation in wear caused by the seams in the prior art is avoided. Therefore, the technical effects of strengthening the protection effect of the fabric on dynamic human bodies and improving the ductility and wearing comfort of the fabric are achieved.

In the present specification, the examples are described progressively, each of which mainly focuses on different aspects from other examples, and reference can be made to each other for the same or similar parts. The description of the device and system disclosed in the examples is relatively simple, because the device and system correspond to the method disclosed in the example, and reference can be made to the description of the method for the related parts.

Since the system example substantially corresponds to the method example, its description is relatively simple, and reference can be made to the description of the method example for the related parts. The apparatus examples described above are only for illustration, and the units described as separated components may or may not be physically separated, the components illustrated as units may or may not be physical units, that is, they can be provided at one position or can be distributed onto multiple network units. Some or all of the modules can be selected to achieve the object of the examples of the invention according to actual requirements. The examples can be understood and implemented by those skilled in the art without creative efforts.

The above description of the disclosed examples enables those skilled in the art to implement or use the present invention. Various modifications made to those examples will be obvious to those skilled in the art, and the ordinal principles defined herein can be implemented in other examples without departing from the spirit or scope of examples of the present invention. Therefore, examples of the present invention should not be limited to those examples disclosed herein, but should be in accordance with the widest scope consistent with the principles and novel characteristics disclosed herein.

The invention claimed is:

1. A fabric manufacturing method comprising:

obtaining information of a fabric functional area setting performed using human morphology information, biomechanical analysis data on kinetic and kinematic, and heat and moisture analysis data, wherein the information of the fabric functional area setting comprises fabric functional area type information;

calling a corresponding relationship between the fabric functional area type information and knitting element information which comprises knitting stitch structure information and knitting action information; and performing integrated forming and seamless knitting of the fabric according to control instructions corresponding to the knitting stitch structure information and the knitting action information.

2. The fabric manufacturing method according to claim 1, wherein said obtaining information of the fabric functional area setting performed using human morphology information, biomechanical analysis data on kinetic and kinematic, and heat and moisture analysis data comprises:

obtaining information of supportive functional area setting generated using human muscular group distribution information and biomechanical analysis data on kinetic muscular groups, wherein types of the reticular supportive functional area comprise:

a reticular mechanical supportive banding group provided at positions corresponding to major kinetic muscular groups, and a gradient supportive banding provided in connection with the mechanical supportive banding; and obtaining information of heat dissipation functional area setting generated using motional heat and moisture analysis data, wherein types of heat dissipation functional area comprise a perspiration transfer area, a moisture absorption and breathable area, a protective thermal buffering area and a thermal buffering area.

3. The fabric manufacturing method according to claim 2, wherein calling the corresponding relationship between the fabric functional area type information and the knitting element information comprises:

calling a corresponding relationship between the reticular mechanical supportive banding and a first knitting element information, and a corresponding relationship between the gradient supportive banding and a second knitting element information, wherein the first knitting element information comprises information of one or any combination of a rib bundle stitch element, a missing stitch element, or a tuck stitch element, and the second knitting element information comprises information of one or any combination of a float plating stitch element, a combined element formed by alternative missing stitch and float plating stitch element, or a jacquard plating stitch element; and calling a corresponding relationship between the perspiration transfer area and a third element information, a corresponding relationship between the moisture absorption and breathable area and a fourth element information, a corresponding relationship between the protective thermal buffering area and a fifth element information, and a corresponding relationship between the thermal buffering area and a sixth element information, the third element information comprises information regarding a reticular mesh element;

the fourth element information comprises information of the float plating stitch element or the jacquard plating stitch element;

the fifth element information comprises information of the missing stitch element or the combined element formed by alternative missing stitch and float plating stitch element; and the sixth element information comprises information of the float plating stitch element or the jacquard plating stitch element.

4. The fabric manufacturing method according to claim 2, wherein types of the supportive functional area further comprise an enhanced supportive area and an enhanced protective padding provided at positions corresponding to parts vulnerable in motion and soft tissues prone to vibration in motion; and obtaining the corresponding relationship between the fabric functional area type information and the knitting element information comprises:

obtaining a corresponding relationship between 1) the enhanced supportive area and the enhanced protective padding and 2) a seventh element information which comprises information of the missing stitch element with adjustable tensile compactness and the rib bundle stitch element with adjustable compressibility.

5. The fabric manufacturing method according to claim 4, wherein providing the enhanced supportive area and the enhanced protective padding at positions corresponding to parts vulnerable in motion and soft tissues prone to vibration in motion comprises:

providing the enhanced supportive area and the enhanced supportive padding in areas corresponding to abdominal muscles, an iliopsoas muscle, a lateral latissimus dorsi muscle, muscles in back shoulders and elbows of an upper body, and in areas corresponding to a preabdomen, a lower back, lower buttocks and patellas of a lower body, respectively.

6. The fabric manufacturing method according to claim 1, wherein the integrated forming and seamless knitting of the fabric performed according to the knitting stitch structure information and the knitting action information comprises:

performing the integrated forming and seamless knitting of the fabric using superfine polyester functional yarn and polyamide elastic covering yarn according to the knitting stitch structure information and the knitting action information.

7. A fabric manufacturing control method comprising:

performing fabric functional area setting using human morphology information, biomechanical analysis data on kinetic and kinematic, and heat and moisture analysis data, wherein the information of the fabric functional area setting comprises fabric functional area type information;

constructing a corresponding relationship between the fabric functional area type information and the knitting element information which comprises knitting stitch structure information and knitting action information; and generating control instructions carrying the knitting stitch structure information and the knitting action information, and instructing integrated forming and seamless knitting of the fabric according to the knitting stitch structure information and the knitting action information.

8. The fabric manufacturing control method according to claim 7, wherein performing fabric functional area setting using human morphology information, biomechanical analysis data on kinetic and kinematic, and heat and moisture analysis data comprises:

performing supportive functional area setting using human muscular group distribution information and biomechanical analysis data on kinetic muscular groups, wherein types of the supportive functional area comprise a reticular mechanical supportive banding group provided at positions corresponding to major kinetic muscular groups, and a gradient supportive banding provided in connection with the reticular mechanical supportive banding; and performing heat dissipation functional area setting using motional heat and moisture analysis data, wherein types of the heat dissipation functional area comprise a perspiration transfer area, a moisture absorption and breathable area, a protective thermal buffering area and a thermal buffering area.

9. The fabric manufacturing control method according to claim 8, wherein constructing the corresponding relationship between the fabric functional area type information and the knitting element information comprises:

constructing a corresponding relationship between the reticular mechanical supportive banding and a first knitting element information, and a corresponding relationship between the gradient supportive banding and a second element information, wherein the first knitting element information comprises information of one or any combination of a rib bundle stitch element, a missing stitch element, or a tuck stitch element, and the second knitting element information comprises information of one or any combination of a float plating stitch element, a combined element formed by alternative missing stitch and float plating stitch element, or a jacquard plating stitch element; and constructing a corresponding relationship between the perspiration transfer area and a third element information, a corresponding relationship between the moisture absorption and breathable area and a fourth element information, a corresponding relationship between the protective thermal buffering area and a fifth element information, and a corresponding relationship between the thermal buffering area and a sixth element information, the third element information comprises information regarding a reticular mesh element;

the fourth element information comprises information of the float plating stitch element or the jacquard plating stitch element;

the fifth element information comprises information of the missing stitch element or the combined element formed by alternative missing stitch and float plating stitch element; and the sixth element information comprises information of the float plating stitch element or the jacquard plating stitch element.

10. The fabric manufacturing control method according to claim 7, wherein types of the supportive functional area further comprise an enhanced supportive area and an enhanced protective padding; and constructing a corresponding relationship between the fabric functional area type information and the knitting element information comprises:

constructing a corresponding relationship between 1) the enhanced supportive area and the enhanced protective padding and 2) a seventh element information which comprises information of a missing stitch element with adjustable tensile compactness or a rib bundle stitch element with adjustable compressibility.

11. The fabric manufacturing control method according to claim 10, wherein providing the enhanced supportive area and the enhanced protective padding at positions corresponding to parts vulnerable in motion and soft tissues prone to vibration in motion comprises:

providing the enhanced supportive area and the enhanced supportive padding in areas corresponding to abdominal muscles, an iliopsoas muscle, a lateral latissimus dorsi muscle, muscles in back shoulders and elbows of an upper body, and in areas corresponding to a preabdomen, a lower back, lower buttocks and patellas of a lower body, respectively.

12. A fabric manufacturing control device, comprising a controller and a memory, wherein the controller is configured for performing fabric functional area setting using human morphology information, biomechanical analysis data on kinetic and kinematic, and heat and moisture analysis data, wherein the information of the fabric functional area setting comprises fabric functional area type information;

constructing a corresponding relationship between the fabric functional area type information and the knitting element information which comprises knitting stitch structure information and knitting action information; and generating control instructions carrying the knitting stitch structure information and the knitting action information, and instructing integrated forming and seamless knitting of the fabric according to the knitting stitch structure information and the knitting action information; and wherein the memory is connected with the controller via an interface, and the memory is configured for storing information of the fabric functional area setting, the corresponding relationship between the fabric functional area type information and the knitting element information, and the control instructions carrying the knitting stitch structure information and the knitting action information.

13. A fabric manufacturing system comprising a fabric manufacturing control device and a seamless fabric manufacturing device, wherein:

the fabric manufacturing control device comprises a controller and a memory, wherein the controller is configured for performing fabric functional area setting using human morphology information, biomechanical analysis data on kinetic and kinematic, and heat and moisture analysis data, wherein the information of the fabric functional area setting comprises fabric functional area type information;

constructing a corresponding relationship between the fabric functional area type information and the knitting element information which comprises knitting stitch structure information and knitting action information; and generating control instructions carrying the knitting stitch structure information and the knitting action information, and instructing integrated forming and seamless knitting of the fabric according to the knitting stitch structure information and the knitting action information; and wherein the memory is connected with the controller via an interface, and the memory is configured for storing information of the fabric functional area setting, the corresponding relationship between the fabric functional area type information and the knitting element information, and the control instructions carrying the knitting stitch structure information and the knitting action information; and the seamless fabric manufacturing device comprises a control device for the seamless fabric manufacturing device and a seamless fabric knitting apparatus, wherein the control device for the seamless fabric manufacturing device is adapted to obtain information of fabric functional area setting performed using human morphology information, biomechanical analysis data on kinetic and kinematic, and heat and moisture analysis data, and call a corresponding relationship between the fabric functional area type information and the knitting element information; and the seamless fabric knitting apparatus is adapted to perform integrated forming and seamless knitting of the fabric according to the control instructions corresponding to the knitting stitch structure information and the knitting action information.

* * * * *